US006839925B2

(12) United States Patent
Myers

(10) Patent No.: US 6,839,925 B2
(45) Date of Patent: Jan. 11, 2005

(54) WHEELED STRETCHER LIFT ASSIST APPARATUS

(76) Inventor: Ronald E. Myers, 3981 W. 1100 S., Warren, IN (US) 46792

( * ) Notice: Subject to any disclaimer, the term of this patent is extended or adjusted under 35 U.S.C. 154(b) by 0 days.

(21) Appl. No.: 10/310,414

(22) Filed: Dec. 5, 2002

(65) Prior Publication Data

US 2003/0106153 A1 Jun. 12, 2003

Related U.S. Application Data

(60) Provisional application No. 60/339,722, filed on Dec. 6, 2001.

(51) Int. Cl.[7] ..... A61G 1/02

(52) U.S. Cl. ..... 5/509.1; 5/86.1; 5/503.1; 296/20

(58) Field of Search ..... 5/610, 611, 86.1, 5/626, 658, 503.1, 509.1; 296/20; 248/188.5, 354.1, 407, 125.8

(56) References Cited

U.S. PATENT DOCUMENTS 559,973 A * 5/1896 Gorham ..... 5/610
1,046,720 A * 12/1912 Barnes ..... 248/407
1,401,554 A * 12/1921 Phillips ..... 5/600
2,251,797 A * 8/1941 Leland, Jr. ..... 5/610
2,588,399 A * 3/1952 McQuin ..... 182/20
3,082,016 A 3/1963 Pratt ..... 280/36
3,669,031 A 6/1972 Cole ..... 108/50
3,687,475 A 8/1972 Wiczer ..... 280/36
3,741,586 A 6/1973 Wiczer ..... 280/150.5
3,782,749 A 1/1974 Wiczer ..... 280/36
3,826,528 A 7/1974 East ..... 296/20
3,878,573 A * 4/1975 Boudewyn ..... 5/658
4,275,896 A 6/1981 Eicher ..... 280/43.1
5,004,263 A 4/1991 Hubbard ..... 280/645
5,520,360 A * 5/1996 Wensman ..... 248/354.5
5,769,371 A * 6/1998 Bandur ..... 248/188.2

* cited by examiner

*Primary Examiner*—Michael F. Trettel
(74) *Attorney, Agent, or Firm*—Taylor & Aust, P.C.

(57) ABSTRACT

A lift assist apparatus for a wheeled stretcher having an end and a height adjustable undercarriage, the lift assist apparatus including an extendable support apparatus detachably rotatably connectable to the end of the wheeled stretcher.

18 Claims, 15 Drawing Sheets

WHEELED STRETCHER LIFT ASSIST APPARATUS

CROSS REFERENCE TO RELATED APPLICATIONS

This application claims the benefit of U.S. provisional patent application Ser. No. 60/339,722, filed Dec. 6, 2001.

BACKGROUND OF THE INVENTION

1. Field of the Invention

The present invention relates to an apparatus and a method to assist in the lifting of a wheeled stretcher, and, more particularly, to a detachable lift assist apparatus for a wheeled stretcher.

2. Description of the Related Art

Wheeled stretchers with a capacity of 400–660 pounds are known in the art. Wheeled stretchers have an extendable undercarriage to allow emergency personnel to lift the stretcher to a desired height for transport. The extendable undercarriage also retracts when the wheeled stretcher is placed into an emergency vehicle. Wheeled stretchers range in weight from approximately 50 pounds to approximately 80 pounds. In addition, ancillary equipment such as oxygen tanks, I.V. posts and related medical articles are often attached to or contained on a wheeled stretcher, thereby adding to the weight. Emergency personnel lift a patient into and onto the wheeled stretcher and the stretcher is elevated. Emergency personnel are required to roughly equally lift the patient plus the weight of the stretcher to an elevated position while releasing a mechanism that allows the undercarriage of the wheeled stretcher to extend, drawn by the force of gravity.

In many job descriptions for emergency personnel it is not unusual to see the requirement that the individual must regularly lift and move more than 100 pounds. This is in the job description because it is not unusual for the emergency personnel to consist of a team of two people, one at each end of a wheeled stretcher. When a patient is placed upon a wheeled stretcher, the emergency personnel position themselves at the end of the wheeled stretcher to lift it. During the lifting period the emergency personnel are lifting the patient weight plus the medical apparatus connected to the stretcher as well as the weight of the stretcher. The weight lifted by each person often greatly exceeds 100 pounds. The lifting requirements of the emergency personnel often put a strain on the backs of the emergency personnel. This has been noted to such an extent that many emergency personnel are trained in lifting and moving patients. Much of the training has to do with lifting techniques, ways of carrying patients and even methods of pushing and pulling the wheeled stretchers. Emergency personnel attempt to use safe lifting techniques by using their legs rather than their back to lift, they also try to keep the weight of the patient in the wheeled stretcher as close to their body as possible. In lifting the weight of the patient there are many considerations; emergency personnel are encouraged to obtain additional help if the patient is particularly heavy. This however is often impossible or impractical because often only two individuals are sent on an emergency run.

One of the problems with the current method is that emergency personnel can be injured in lifting patients; in particular, heavy patients on wheeled stretchers.

What is needed in the art is an easy to use apparatus to reduce the amount of weight that each emergency personnel must lift in elevating a patient on a wheeled stretcher.

SUMMARY OF THE INVENTION

The present invention relates to a lift assist apparatus for a wheeled stretcher.

The present invention comprises, in one form thereof, a lift assist apparatus for a wheeled stretcher having an end and a height adjustable undercarriage, the lift assist apparatus including an extendable support apparatus detachably rotatably connectable to the end of the wheeled stretcher.

An advantage of the present invention is that an emergency crew can reduce the amount of weight lifted to elevate a wheeled stretcher.

Another advantage of the present invention is that the lift assist apparatus can be stowed along the side of a wheeled stretcher.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
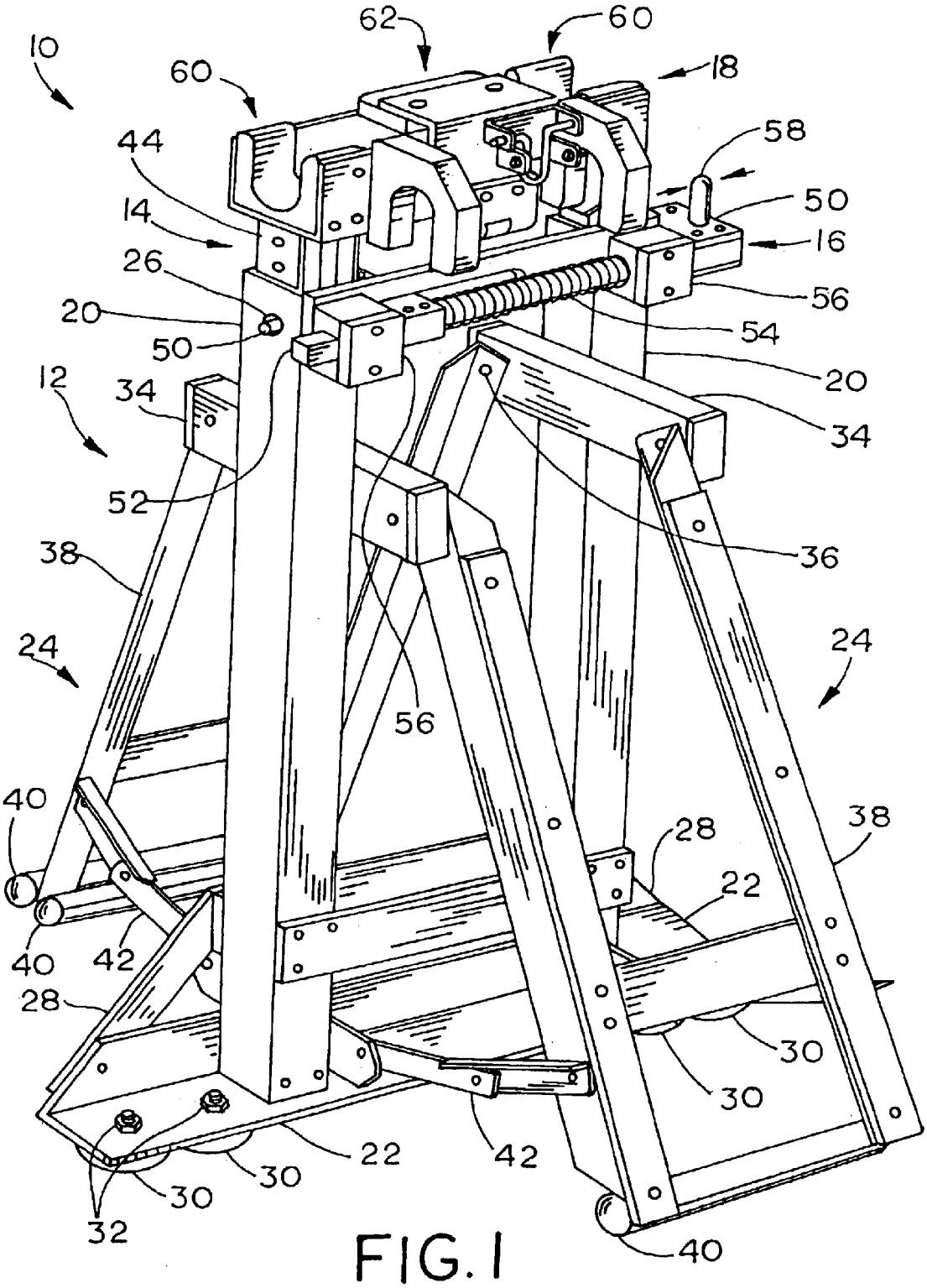
FIG. 1 is a perspective view of a lift assist apparatus according to one embodiment of the present invention.

Referring now to the drawings, and more particularly to FIG. 1, there is shown a lift assist apparatus 10 for a wheeled stretcher embodying the present invention. Lift assist apparatus 10 includes support structure 12, extension apparatus 14, extension latch device 16 and stretcher interface mechanism 18.

Support structure 12 includes hollow support 20, base 22 and outriggers 24. Hollow support 20 is provided to allow extension apparatus 14 to extend therefrom or to be stowed in hollow support 20. Hollow support 20 includes latch holes 26 through which extension latch device 16 positions extension apparatus 14 to an adjustable yet fixed position relative to hollow support 20.

Base 22 includes angular braces 28, skid resistant feet 30 and bolts 32. Angular brace 28 interconnects with a side of hollow support 20 and with base 22 to provide stability to lift assist apparatus 10. Skid resistant feet 30 are attached to a bottom side of base 22 to effectively reduce the slipping of lift assist apparatus 10 when in contact with a floor or the ground. Bolts 32 secure skid resistant feet 30 to base 22.

Outriggers 24 include arms 34, pivot points 36, outrigger legs 38, skid resistant feet 40 and pivot restraints 42. Arms 34 extend from an upper portion of hollow support 20 and they are generally perpendicular to hollow supports 20. Toward an end of each arm 34 there is a pivot points 36, which may be a rivet, a bolt or other attaching device, which connects an arm 34 with an outrigger leg 38 and allows them to pivot. Outrigger legs 38 extend from the body of lift assist apparatus 10 to provide stability to apparatus 10. Pivot restraints 42 limit the angular displacement of outrigger legs 38 from hollow support 32 and base 22. At a distal end of outrigger legs 38 there are positioned skid resistant feet 40. As can be seen in FIG. 1, on at least one of the outriggers 24 there is positioned two skid resistant feet 40 in anticipation of the application of this apparatus in a non-vertical position when attached to a wheeled stretcher. Pivot restraints 42 may be in the form of articulated arms 42, which, when extended in an over centered position, lock outriggers 24 into an extended position.

Figure 2:
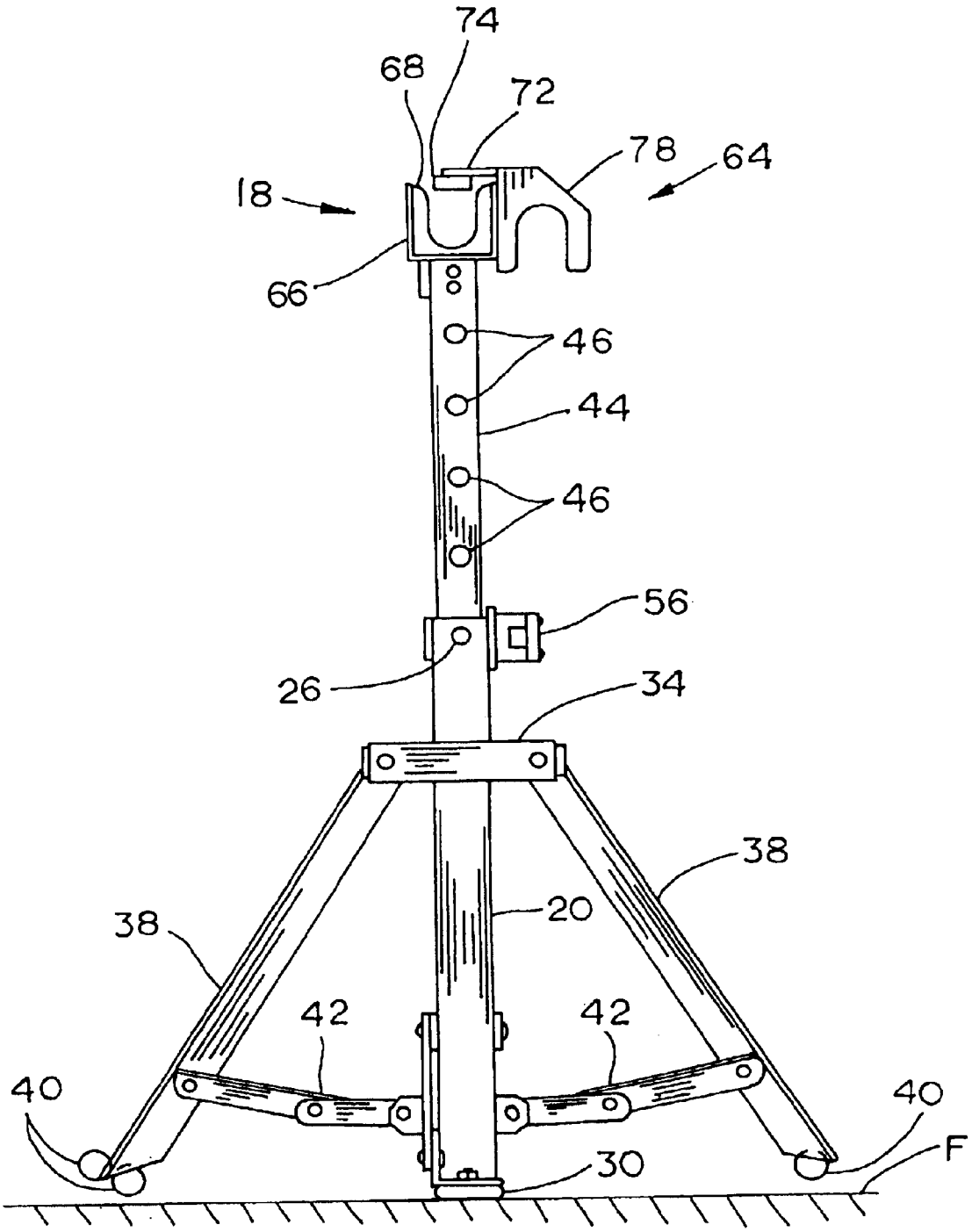
FIG. 2 is a side view of the lift assist apparatus of FIG. 1.
Figure 3:
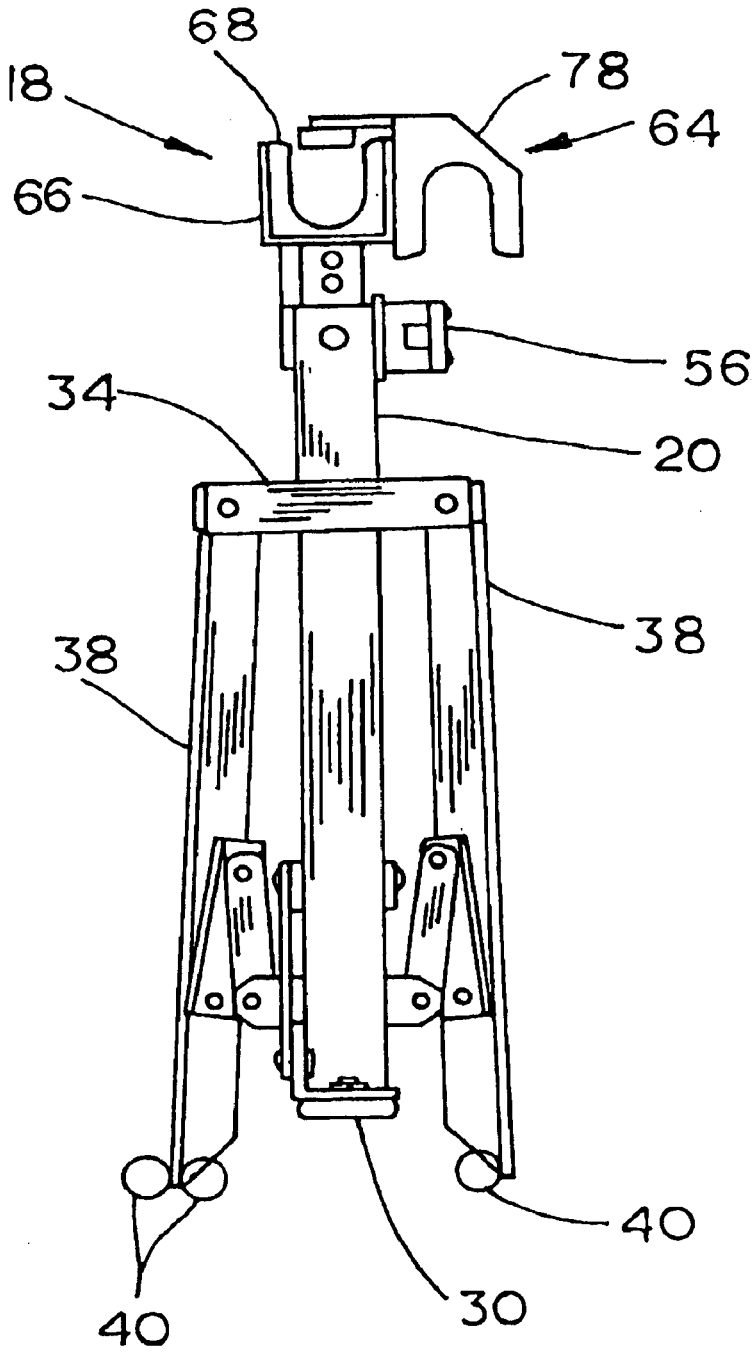
FIG. 3 is another side view of the lift assist apparatus of FIGS. 1 and 2 in a folded position.

Now, additionally referring to FIG. 2, there is shown extension apparatus 14 including extendable support 44 and positioning holes 46. Extendable support 44 slides into and out of hollow support 20. Holes 46 are positioned along extendable support 44 to allow an adjustable positioning of stretcher interface mechanism 18.

Extension latch device 16 includes guide bar 48, latch finger 50, biased bar 52, spring 54, retention block 56 and handle 58. Guide bar 48 has a slot therein for the directing of latch finger 50 through latch hole 26 and positioning hole 46. Latch fingers 50 extend through hollow support 20 and extendable support 44 to thereby position extendable support 44 in a desired position. Biased bar 52 is attached to both latch fingers 50 to thereby coordinate the latching of both extendable supports 44 at the same position. Biased bar 52 has a spring 54 therearound to bias extension latch device 16 into a latched position. Retention block 56 retains biased bar 52 in a sliding manner and positions latch fingers 50 so as to engage latch hole 26. Handle 58 is connected to a latch finger 50 that is connected to biased bar 52. Handle 58 allows an operator to move both latch fingers 50 simultaneously to thereby engage positioning holes 46 of extendable support 44 with one action.

Figure 4:
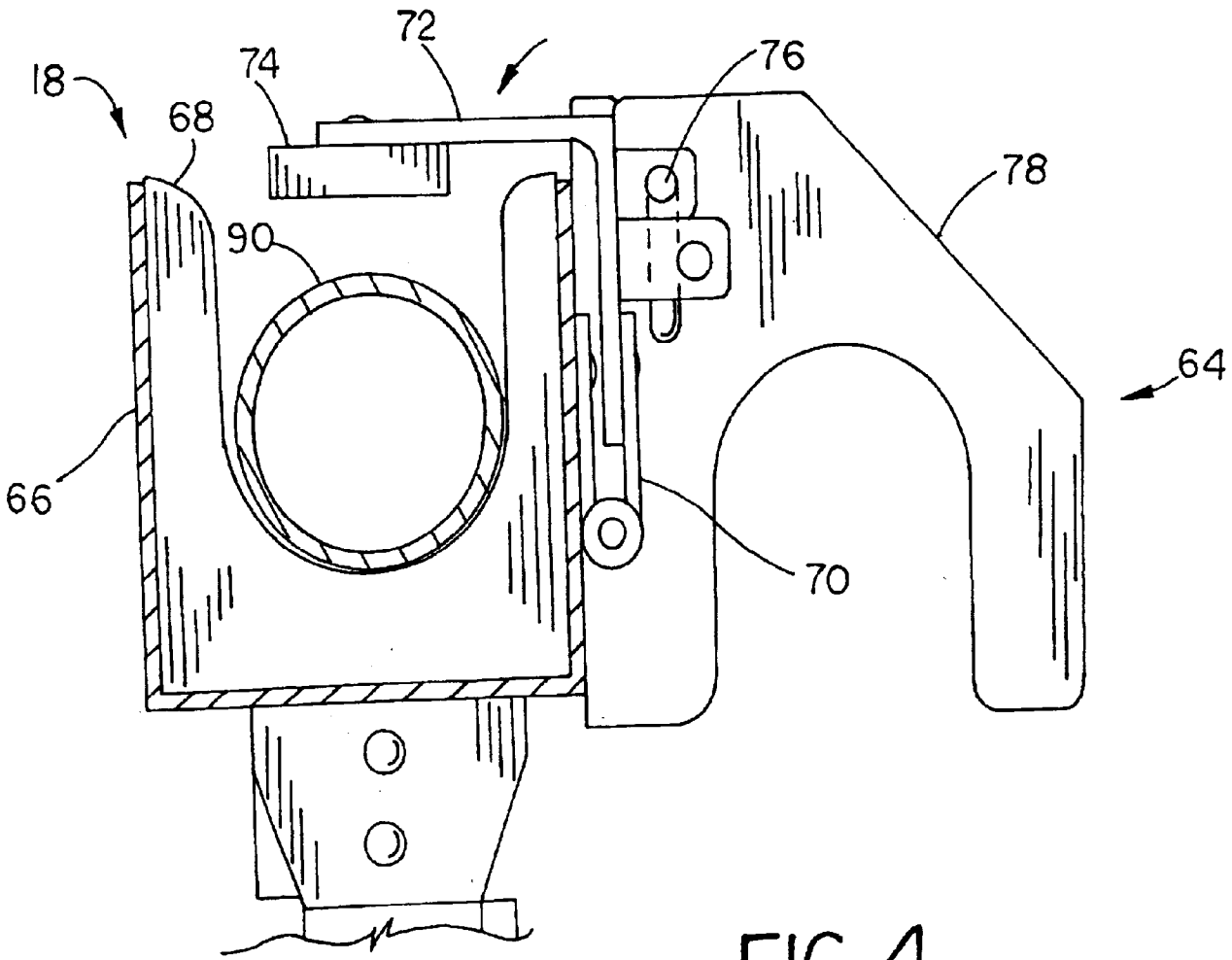
FIG. 4 is a cross-sectional view of the stretcher interface mechanism of the lift assist apparatus of FIGS. 1–3.

Now, additionally referring to FIG. 4 there is shown a cross-sectional view of stretcher interface mechanism 18 including stretcher cradle 60, stretcher retention device 62 and stowage mechanism 64. Stretcher cradle 60 includes U-channel 66 and U-shaped pads 68. U-channel 66 is connected to a top portion of extendable support 44. U-shaped pads 68 are positioned within U-channel 66 and shaped to accommodate a frame of a wheeled stretcher.

Stretcher retention device 62 includes hinge 70, L-retainer 72, retention pad 74 and slide latch 76. Hinge 70 is connected to a side of U-channel 66 and to L-retainer 72. Hinge 70 allows L-retainer 72 to swing away from U-shaped pads 68 to allow a frame 90 of a wheeled stretcher to be inserted and positioned in U-shaped pad 68. L-retainer 72 is the swung back into position above frame 90 to thereby retain frame 90. Retention pad 74 is attached to an end of L-retainer 72 to prevent abrasion to frame 90. Retention pad 74, as well as U-shaped pad 68, may be made from a synthetic polymer with a non-abrasive nature. Slide latch 76 secures L-retainer 72 in position to thereby prevent frame 90 from becoming disengaged from lift assist apparatus 10.

Figure 5:
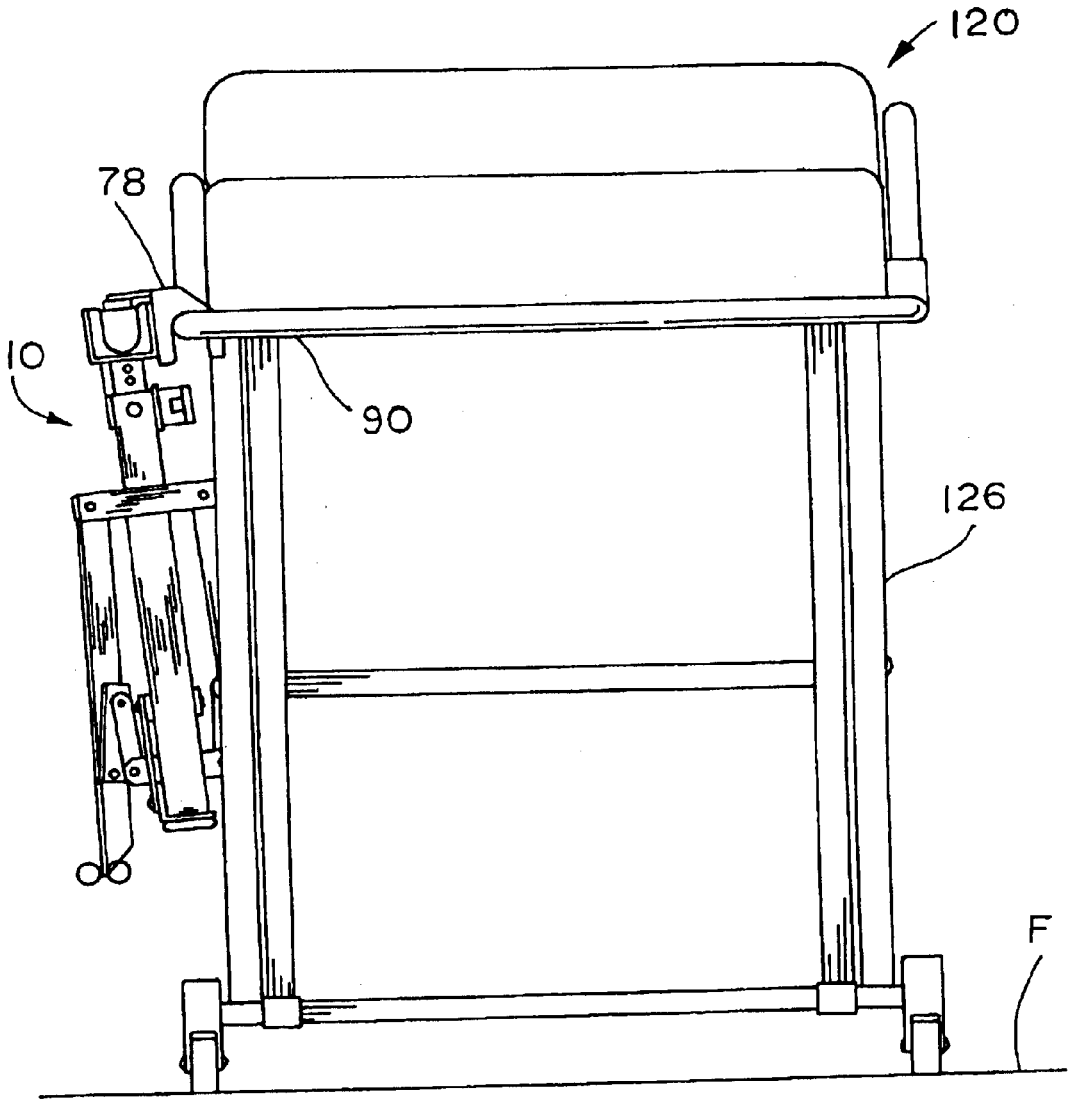
FIG. 5 illustrates the stowing of the lift assist apparatus of FIGS. 1–4 along the side of a wheeled stretcher.

Stowage mechanism 64 includes stretcher frame hooks 78. Stretcher frame hooks 78 may also be made from a non-abrasive polymer that advantageously allow lift assist apparatus 10 to be stowed along side of a wheeled stretcher as shown in FIG. 5.

Figure 6:
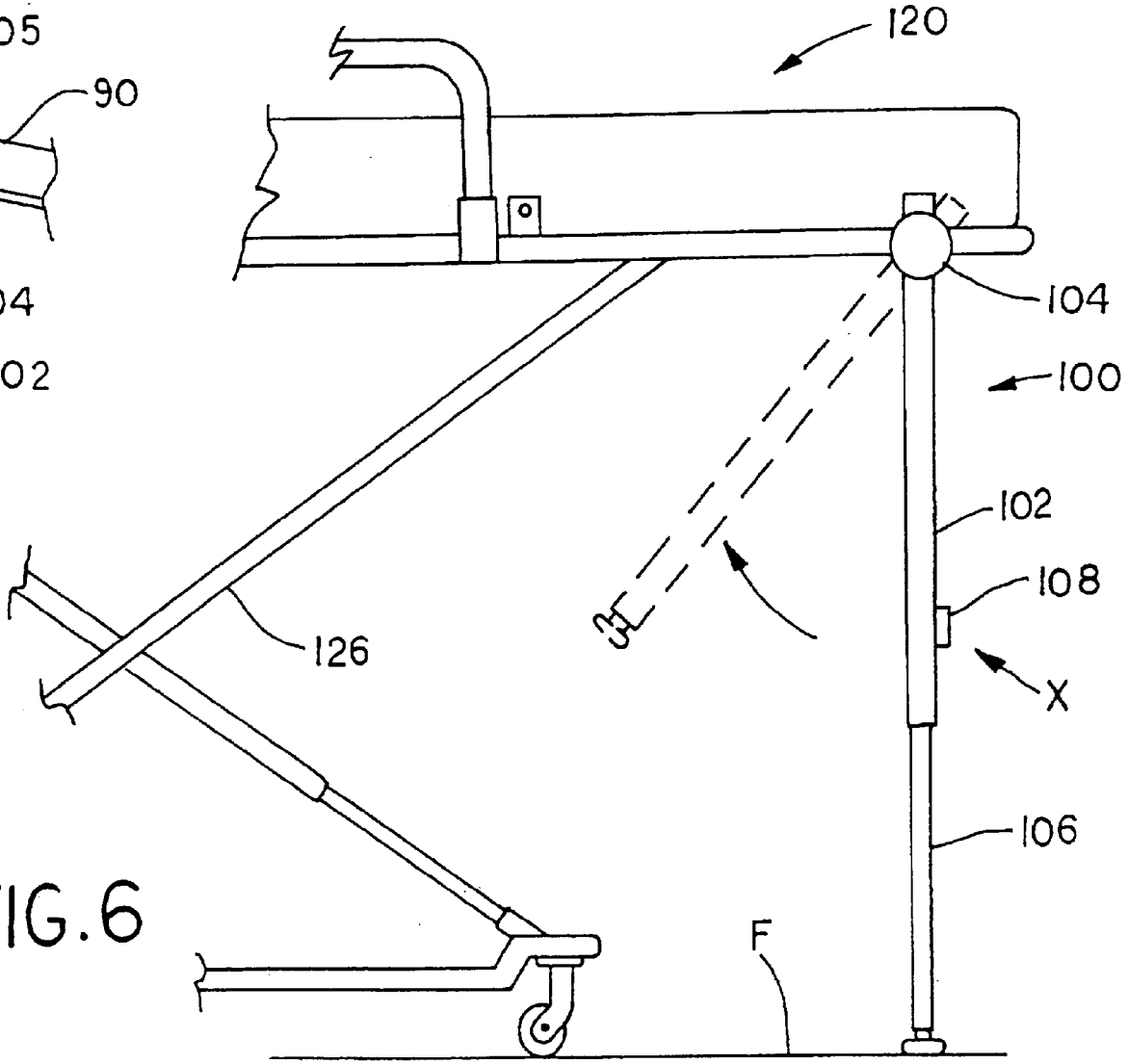
FIG. 6 is a side view of a lift assist apparatus of another embodiment of the present invention connected to a wheeled stretcher.
Figure 7:
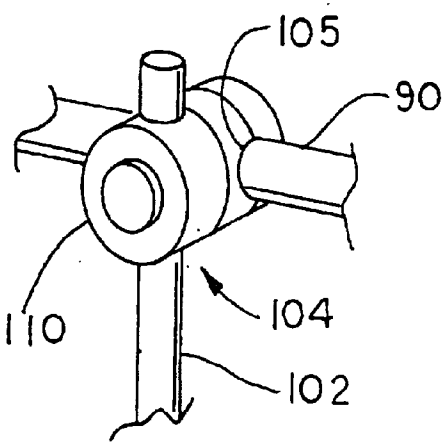
FIG. 7 illustrates the rotating stretcher interface of the lift assist apparatus of FIG. 6.

Now, additionally referring to FIGS. 6 and 7, there is shown another embodiment of a lift assist apparatus 100 of the present invention in the form of stretcher pivot stand 100. Stretcher pivot stand 100 includes an extendable leg 102, a rotating stretcher interface 104, a telescoping portion 106, a ratchet release/lock 108 and a rotational release/lock 110. Extendable leg 102 is connected to rotating stretcher interface 104 and is thereby rotationally connected to frame member 90 of wheeled stretcher 120. Extendable leg 102 is slidingly engaged with telescoping portion 106 that slides in and out of extendable leg 102. Rotating stretcher interface 104 is detachably mounted to frame member 90 of wheeled stretcher 120. Rotating stretcher interface 104 has a contoured surface 105 that matches the contour of frame 90. Rotating stretcher interface 104 has a rotational release lock 110, which locks stretcher pivot stand 100 in a position approximately perpendicular to frame 90.

When rotational release lock 110 is depressed it releases the rotational lock and allows extendable leg 120 to rotate in either direction and it remains in an unlocked position unless rotated into a position normal with frame 90 or parallel with frame 90. Rotational stretcher interface 104, when in a released state, allows extendable leg 102 to rotate freely until being in one of the two aforementioned positions. Telescoping portion 106 has a foot member that encounters floor F. When an end of wheeled stretcher 120 is lifted, telescoping portion 106 freely falls and maintains contact with floor F. Ratchet release lock 108 interacts with telescoping portion 106 to latch telescoping portion 106 in an extended position. Anytime the end of wheel stretcher 120, having pivot stand 100 attached thereto, is lifted telescoping portion 106 will extend thereby ratcheting the elevation of wheeled stretcher 120 in position. Once wheeled stretcher 120 has been raised sufficiently, rotational release lock 110 is depressed allowing wheeled stretcher pivot stand 100 to be rotated in a stowed position parallel with frame 90. Once wheeled stretcher pivot stand 100 is rotated into a position parallel with frame 90. Ratchet/release lock 108 is depressed and telescoping portion 106 is stowed back inside of extendable leg 102.

Advantageously, more than one stretcher pivot stand 100 may be connected to wheeled stretcher 120. Further, stretcher pivot stand 100 may be connected to an end of wheeled stretcher 120 even though shown connected to a side in FIG. 6.

Figure 8:
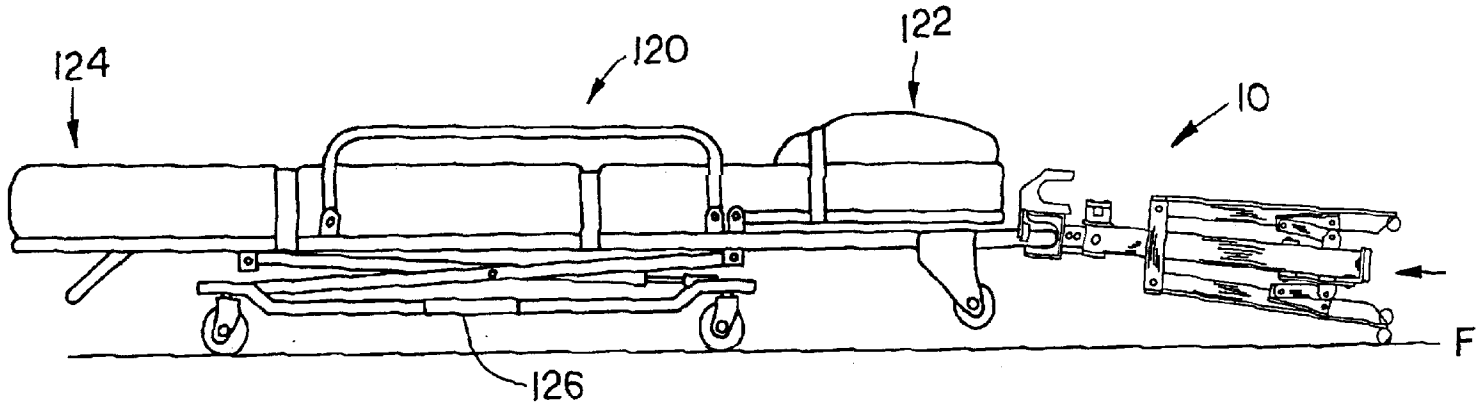
FIG. 8 illustrates a wheeled stretcher having the lift assist apparatus of FIGS. 1–5 connected to an end of the wheeled stretcher.
Figure 9:
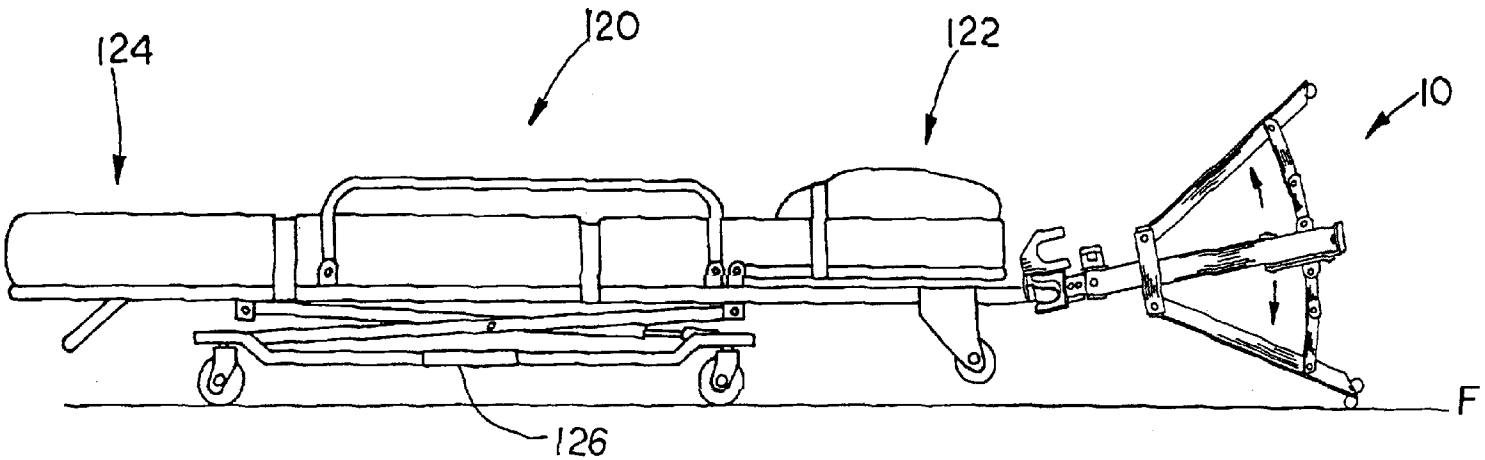
FIG. 9 illustrates the lift assist apparatus of FIGS. 1–5 and 8 with the outriggers fully extended.
Figure 10:
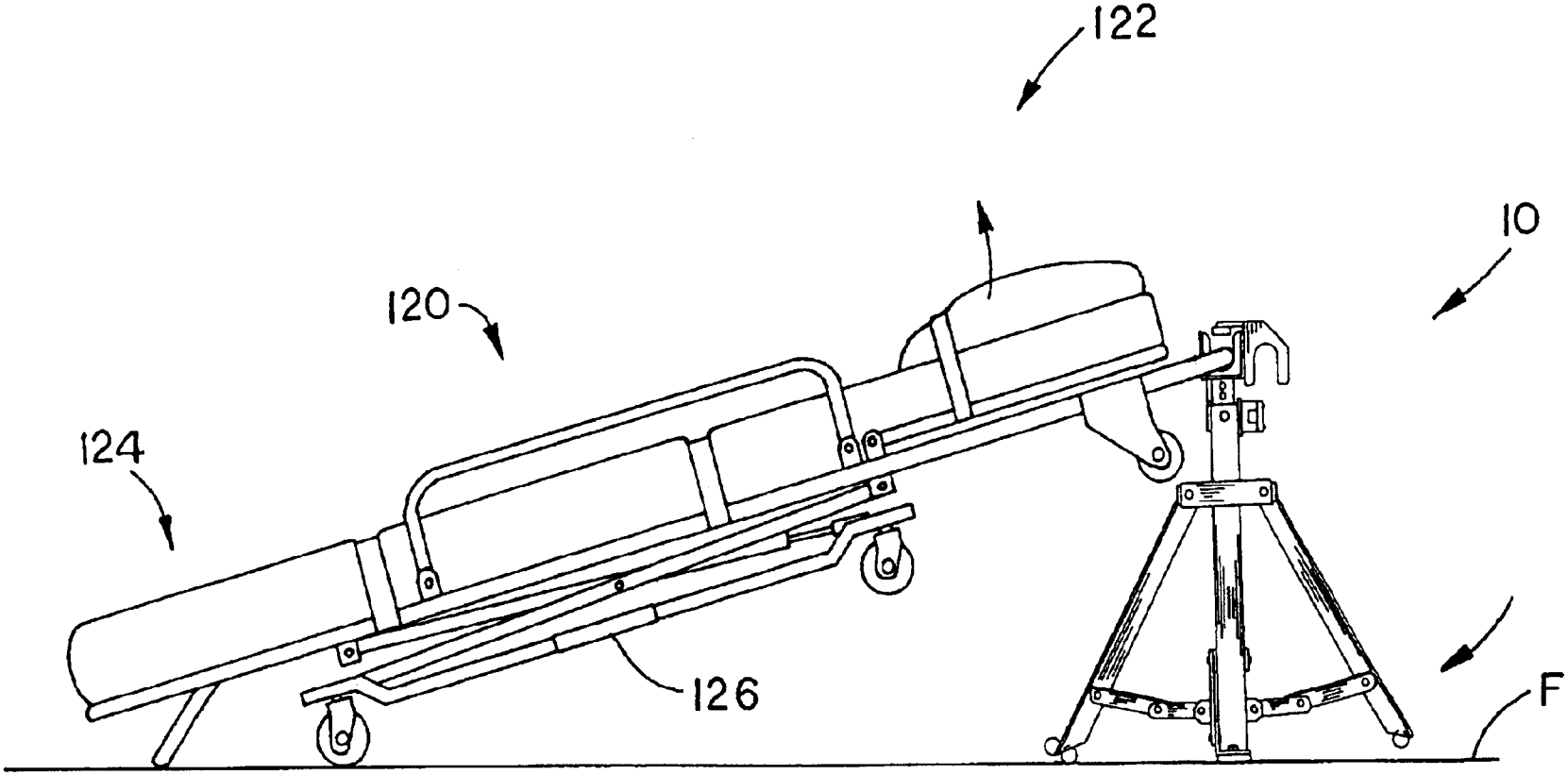
FIG. 10 illustrates the positioning of the wheeled stretcher having one end lifted and the lift assist apparatus supporting an end of the wheeled stretcher.

Now additionally referring to FIGS. 8–17 there is illustrated a method of lifting wheeled stretcher 120 into an elevated position. FIG. 8 illustrates the attachment of wheeled stretcher lift apparatus 10 to frame 90 of wheeled stretcher 120 at a head end 122 of wheeled stretcher 120. The time taken to effect the attachment is very short, on the order of ten seconds and even less than five seconds for someone familiar with the operation of stretcher retention device 62. Stretcher interface mechanism 18 is used to connect and captivate frame member 90. As shown in FIG. 9, outriggers 24 are extended into a deployed position also known as a locked position. Now, as shown in FIG. 10, head end 122 of wheeled stretcher 120 is lifted by emergency personnel thereby allowing wheeled stretcher lift assist apparatus 10 to swing into a supporting position. This lift is advantageously done with the emergency personnel positioned proximate head end 122 thereby proportionally reducing the strain on each member of the emergency team. At this point, head end 122 is in an elevated position, which continues to be a comfortable position for a patient lying on wheeled stretcher 120.

Figure 11:
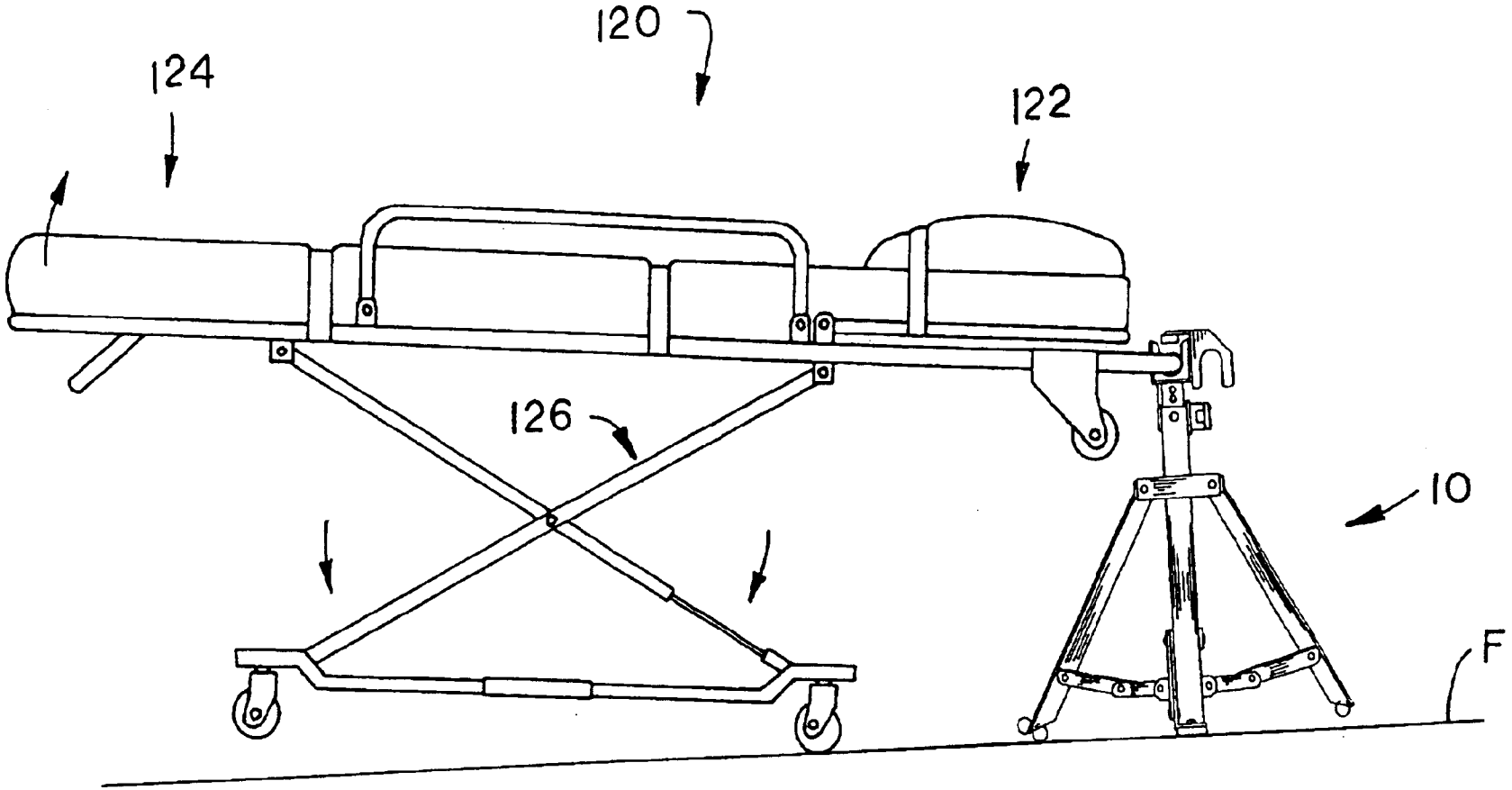
FIG. 11 illustrates the wheeled stretcher having its undercarriage extended once a foot end of the wheeled stretcher has been lifted.
Figure 12:
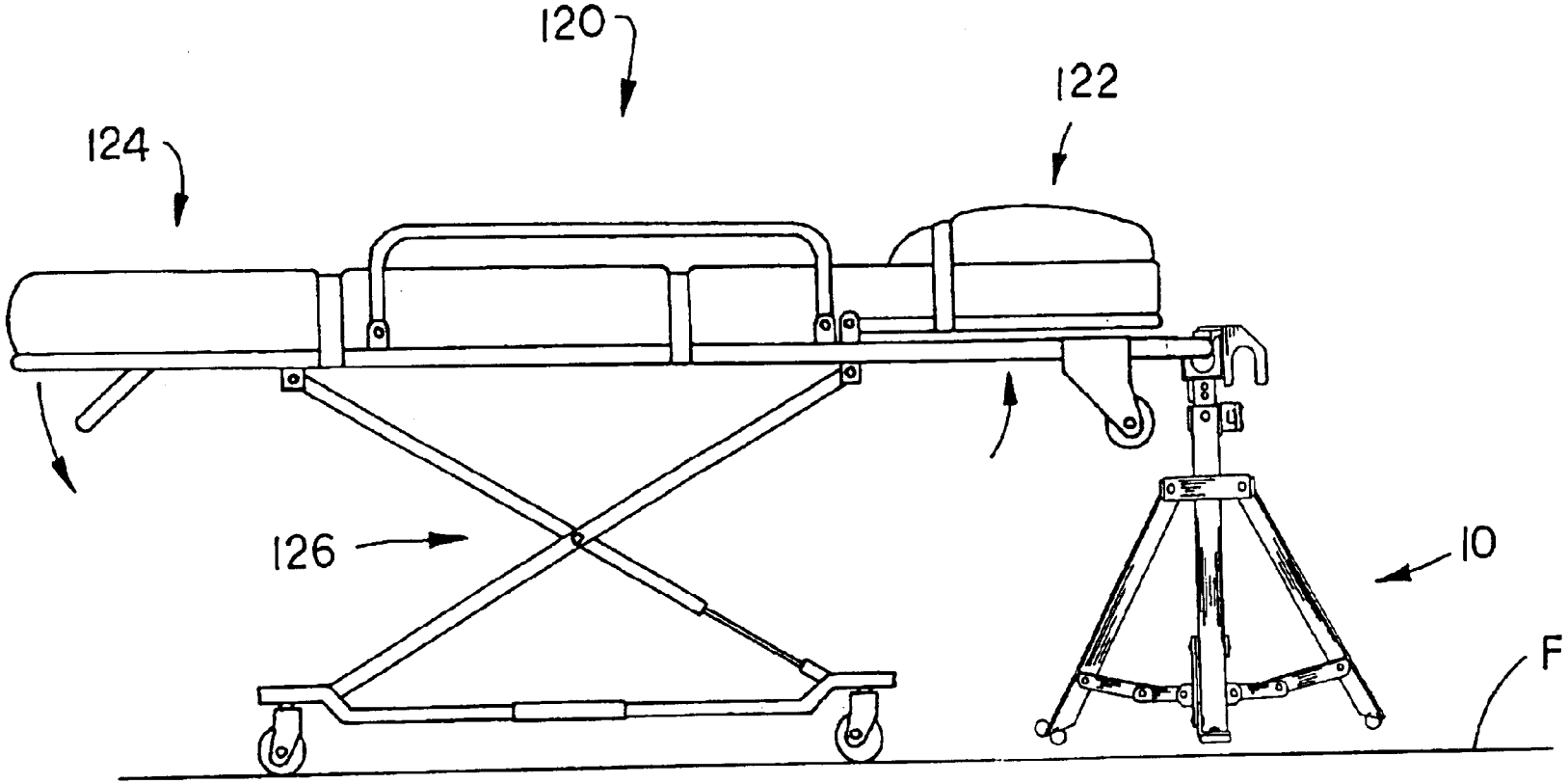
FIG. 12 illustrates the lift assist apparatus of FIGS. 1–5 and 8–11 being suspended by the wheeled stretcher.
Figure 13:
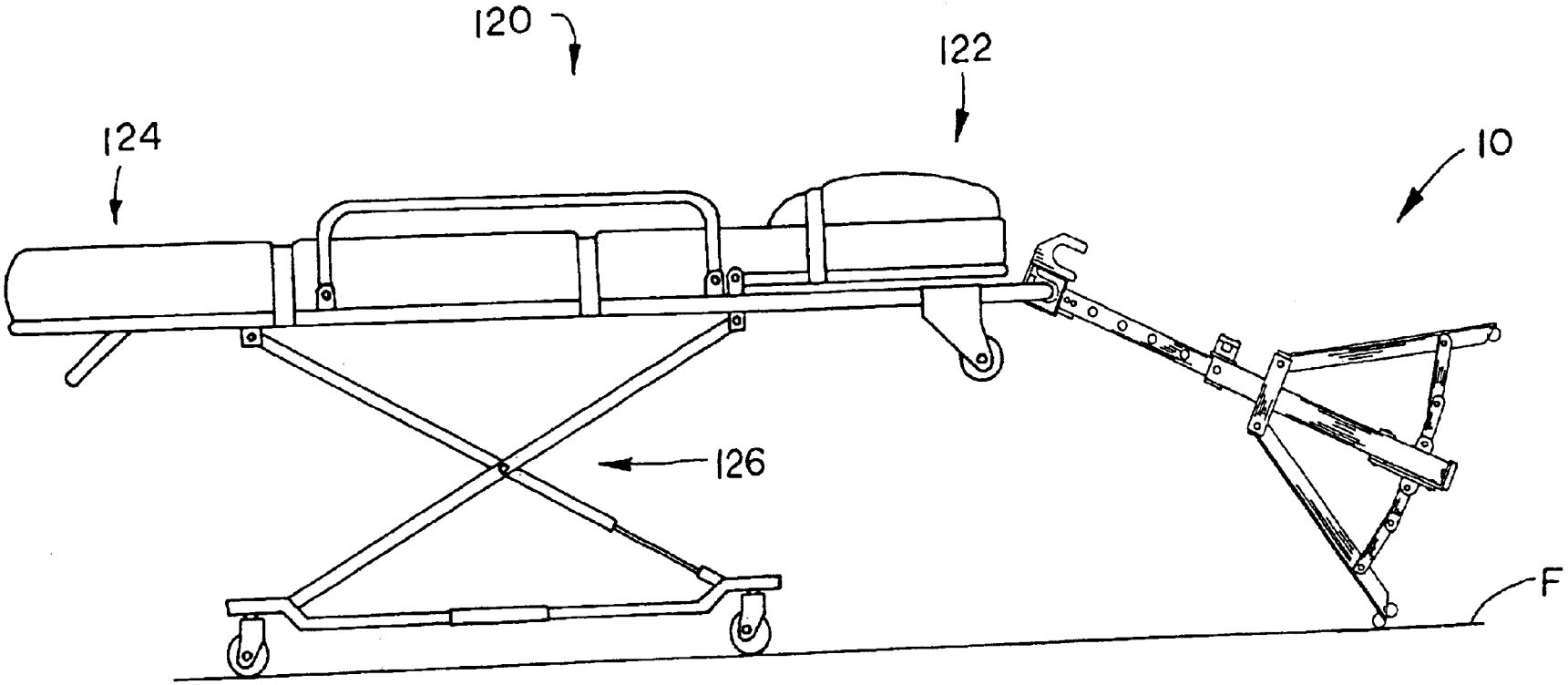
FIG. 13 illustrates the lift assist apparatus of FIGS. 1–5 and 8–12 in an extended position.
Figure 14:
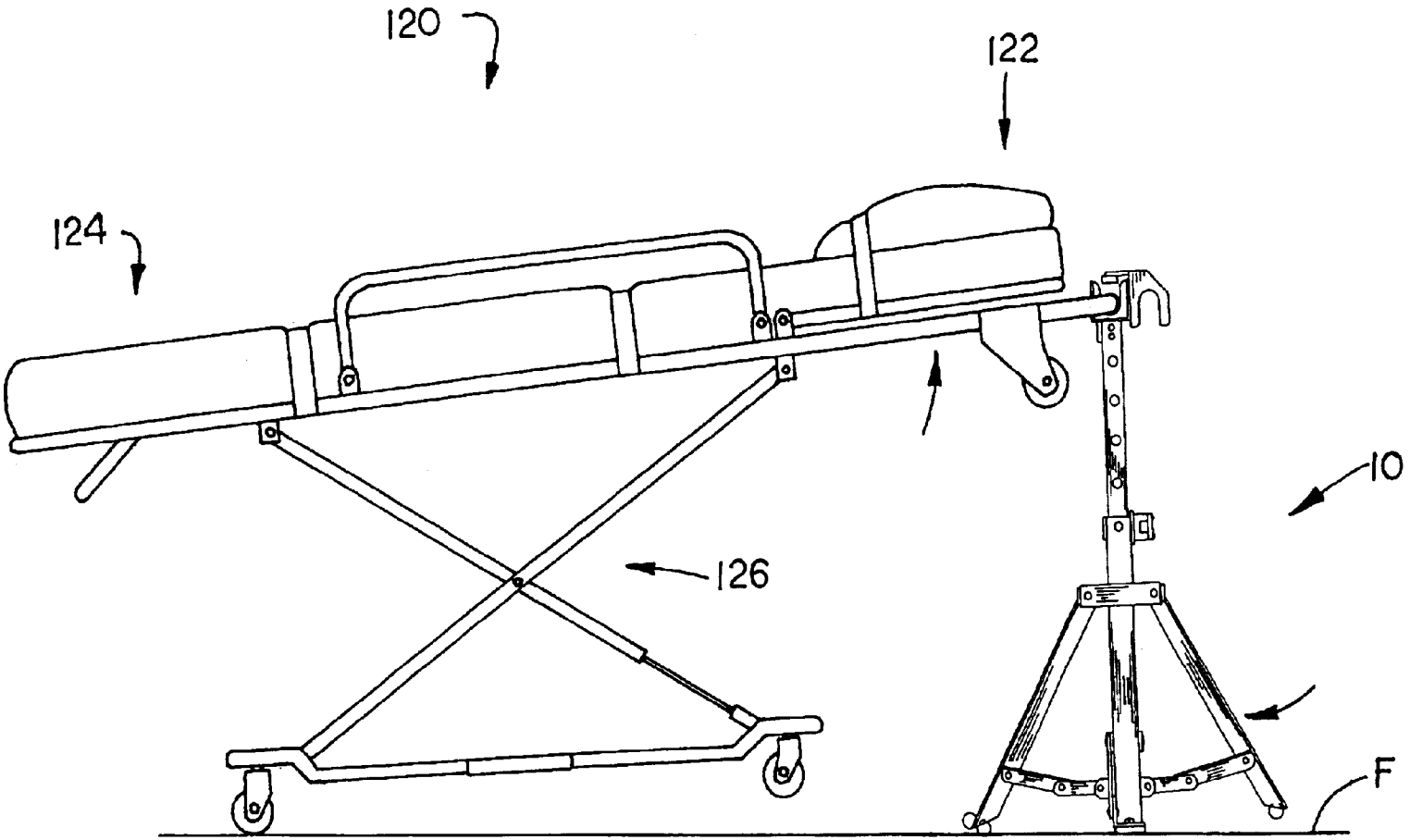
FIG. 14 shows the head end of a wheeled stretcher being lifted and the lift assist apparatus of FIGS. 1–5 and 8–13 swinging into support the wheeled stretcher.
Figure 15:
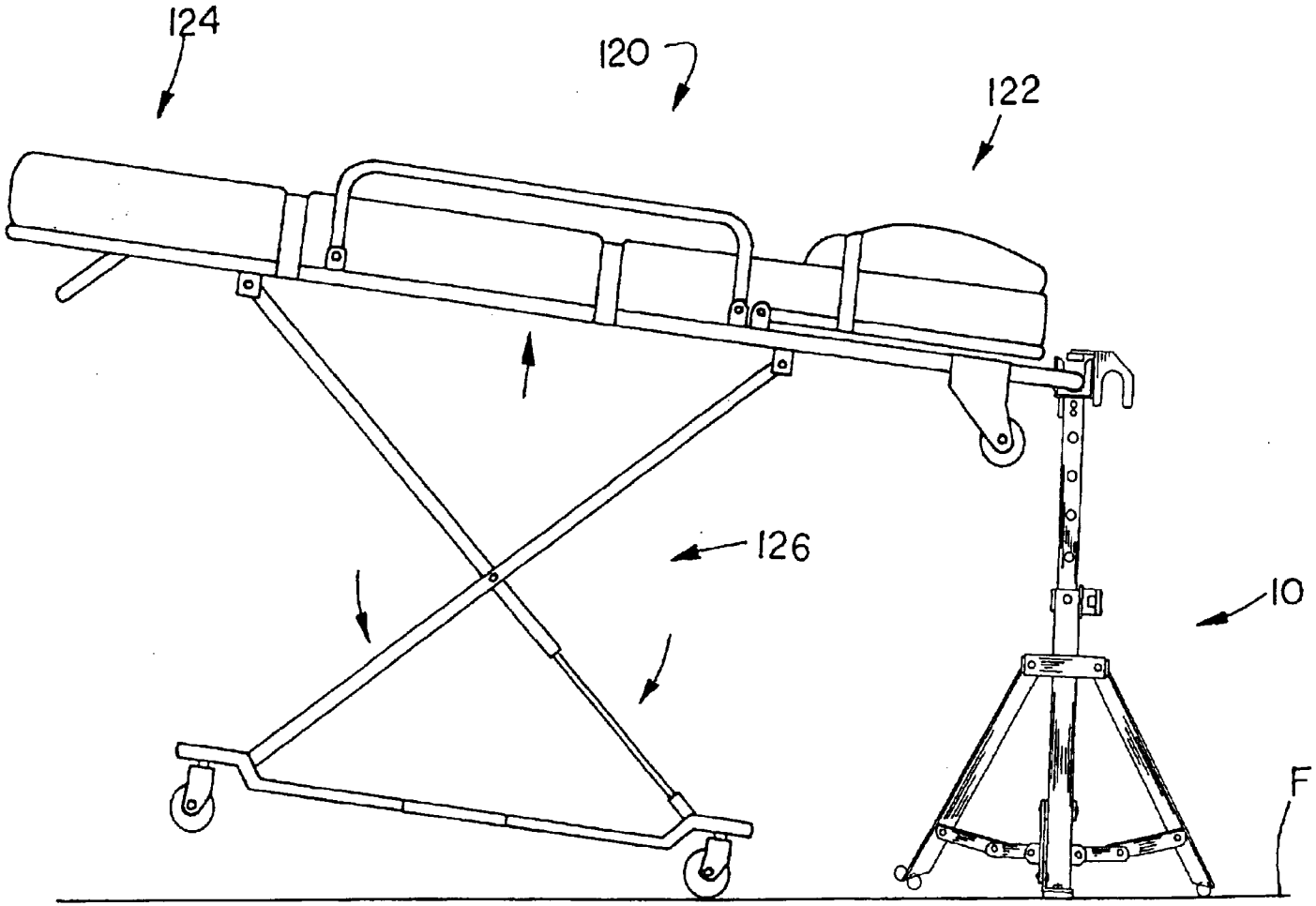
FIG. 15 shows the foot end of a wheeled stretcher having been lifted and the undercarriage of the wheeled stretcher being fully extended.
Figure 16:
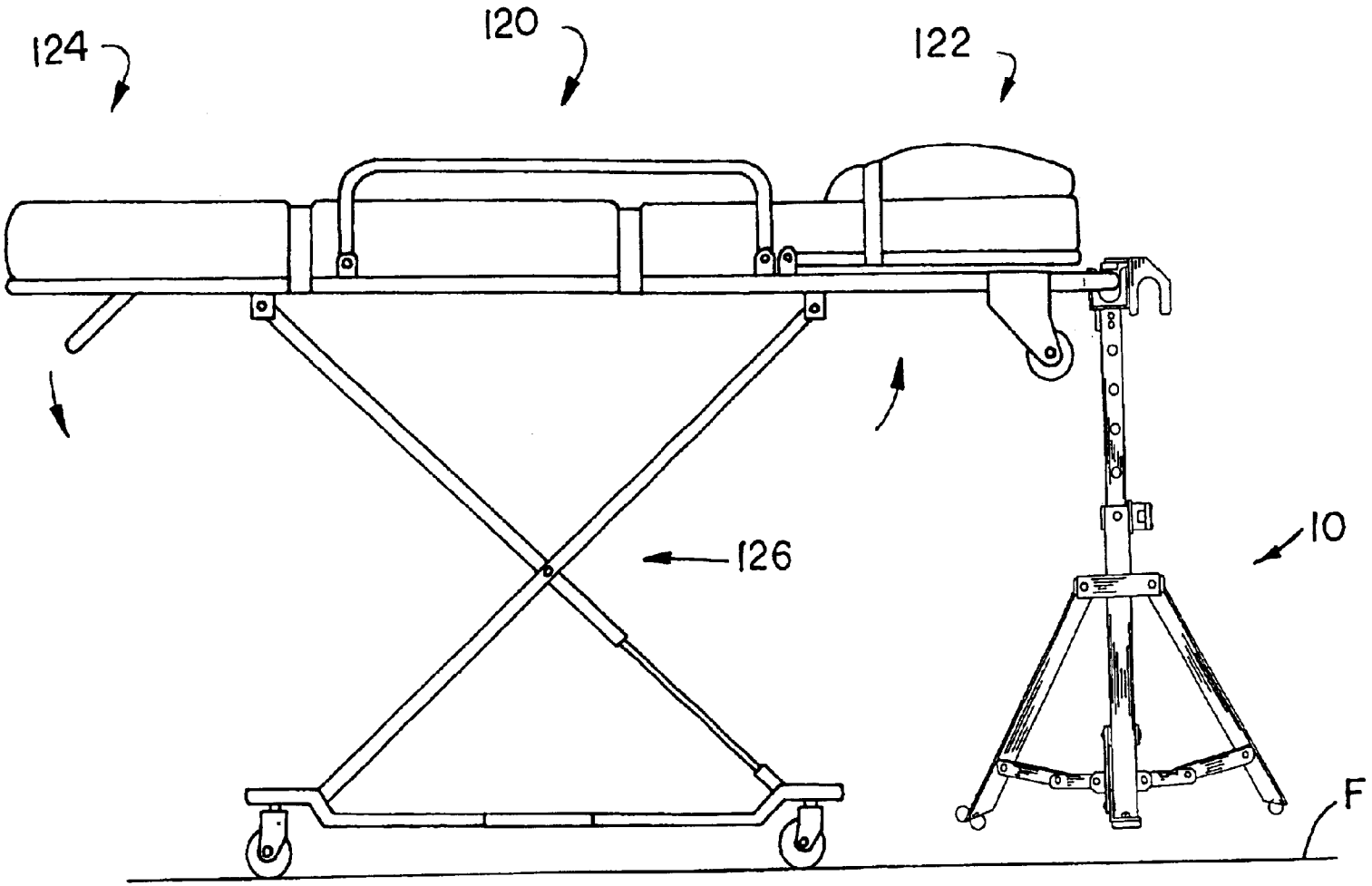
FIG. 16 illustrates the wheeled stretcher in a fully elevated and supported by the undercarriage with the lift assist apparatus of FIGS. 1–5 and 8–15 hanging therefrom.
Figure 17:
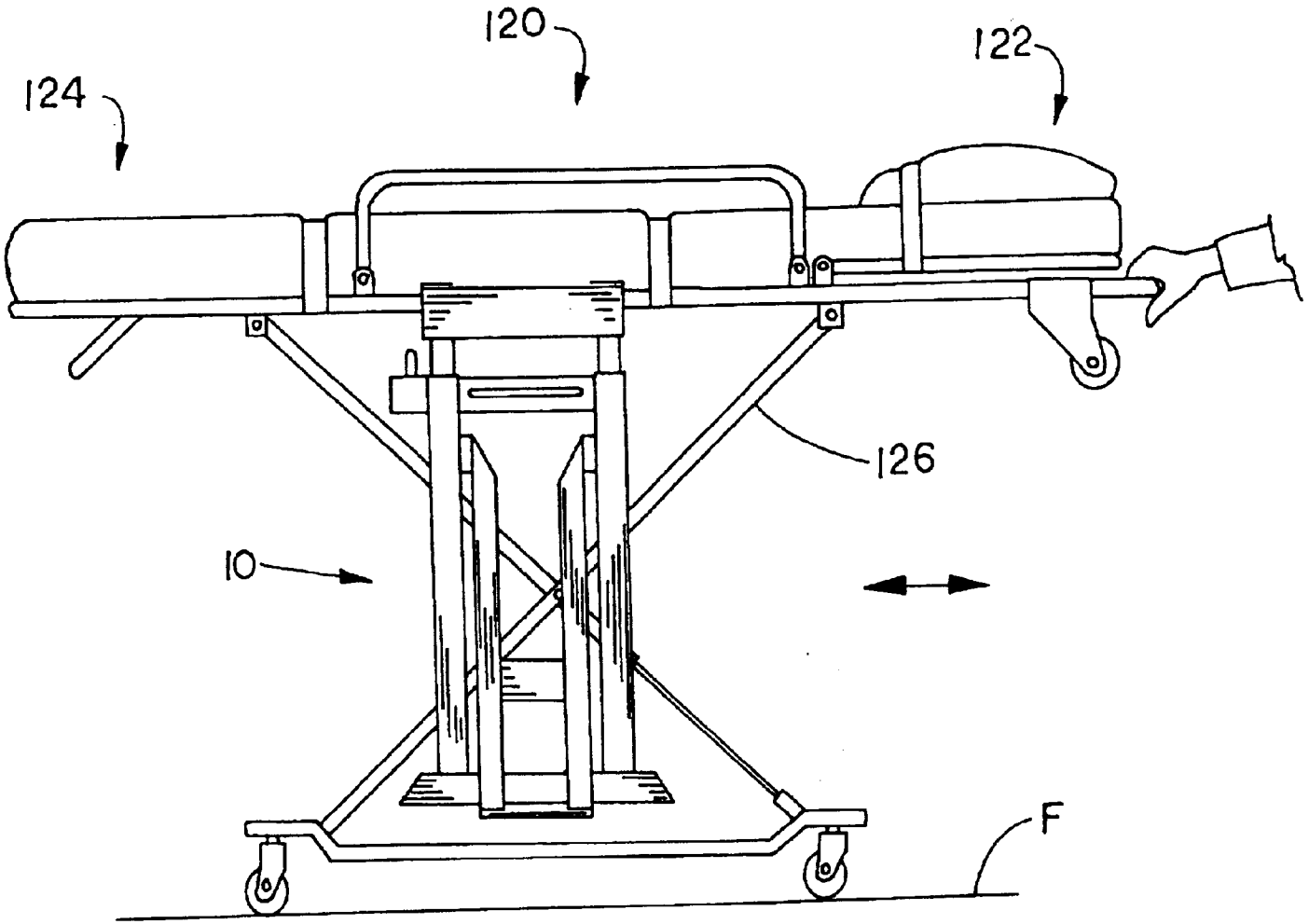
FIG. 17 illustrates movement of the wheeled stretcher with the lift assist apparatus of FIGS. 1–5 and 8–16 folded and stowed along a side of the wheeled stretcher.

Now as can be seen in FIG. 11, foot end 124 of wheeled stretcher 120 is lifted by emergency personnel and a wheeled scissor support 126 is released by the personnel to extend engaging floor F. Typically foot end 124 is lifted to a point in which wheeled scissor support 126, when extended, will only engage one set of wheels allowing wheeled stretcher lift assist apparatus 10 to be relieved of the weight thereon as shown in FIG. 12. There being no weight now on lift assist apparatus 10, it can be swung free as shown in FIG. 13 and extension apparatus 14 utilized to extend the height of lift assist apparatus 10. Then similar to what has been shown previously in FIG. 10, head end 122 of wheeled stretcher 120 is lifted as shown in FIG. 14 thereby elevating the patient to a greater height. Foot end 124 is then lifted again, similar to what was previously shown in FIG. 11, and as now represented in FIG. 15 to more fully extend scissor support 126. Emergency personnel then allow foot end 124 to come back to an approximate level position with head end 122. Wheeled stretcher 120 is then fully supported by wheeled scissor support 126 as shown in FIG. 16. Lift assist apparatus 10 is removed from frame 90 near head end 122 of stretcher 120. Extension apparatus 14 is collapsed thereby shortening lift assist apparatus 10 and stretcher frame hooks 78 are utilized to hang along the side of wheeled stretcher 120 thereby allowing easy transport of lift assist apparatus 10 in a stowed position along with the patient on wheeled stretcher 120. FIG. 17 illustrates lift assist apparatus 10 carried by wheeled stretcher 120 in a stowed position.

The forgoing method illustrated with lift assist apparatus 10 can, in a very similar manner, be used with wheeled stretcher pivot stand 100 to achieve the same desired lifting of a patient on wheeled stretcher 120.

Advantageously, lift assist apparatus 10 allows the lifting of stretcher 120 one end at a time thereby substantially reducing the amount of lifting force required by emergency personnel This reduction in lifting force reduces the strain on personnel, reduces injuries to emergency personnel in lifting patients and allows emergency personnel to lift heavier patients safely. Also advantageously, lift assist apparatus 10 can be utilized on many existing wheeled stretchers 120 not requiring any retrofit or modification of wheeled stretchers 120. Also, the detachable nature of lift assist apparatus 10 and 100 allow the apparatus to be stowed in emergency vehicles and used only with the stretchers taken into a patients home, factory or injury site. Lift assist apparatus 10 or 100 can then be stowed in the emergency vehicle and used by those personnel alone. Upon arriving at a hospital or emergency treatment center, emergency personnel would remove wheeled stretcher 120 from the emergency vehicle in a conventional manner and take the patient to receive treatment.

A further advantage of lift assist apparatus 10 and 100 is that one emergency person can lift wheel stretcher 120 one end at a time. While this particular method of operation will not lessen the amount of lifting force that is required, since one individual is lifting half of the weight, it does allow one person working alone to elevate wheeled stretcher 120.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A lift assist apparatus for a wheeled stretcher having an end and a height adjustable undercarriage, the lift assist apparatus, comprising:

an extendable support apparatus detachably rotatably connectable to the end of the wheeled stretcher, said extendable support apparatus including at least one outrigger that is pivotally connected thereto.

2. The lift assist apparatus of claim 1, further comprising a latch device to releasably latch said extendable support to a fixed length.

3. The lift assist apparatus of claim 1, wherein said extendable support apparatus is detachably connectable to the stretcher in less than 10 seconds.

4. The lift assist apparatus of claim 1, further comprising a retention device connected to said extendable support apparatus, said retention device configured to releasably connect to a portion of the wheeled stretcher.

5. A lift assist apparatus for a wheeled stretcher having an end and a height adjustable undercarriage, the lift assist apparatus, comprising:

an extendable support apparatus detachably rotatably connectable to the end of the wheeled stretcher; and at least one outrigger connected to said extendable support apparatus, said at least one outrigger includes a first outrigger and a second outrigger, said first outrigger pivotally connected to a side of said extendable support apparatus, said second outrigger pivotally connected to an other side of said extendable support apparatus.

6. The lift assist apparatus of claim 5, further comprising a plurality of pivot restraints at least one of said pivot restraints connected to said first outrigger and at least one of said pivot restraints connected to said second outrigger, said plurality of pivot restraints limiting the extent said first outrigger and said second outrigger may pivot.

7. The lift assist apparatus of claim 6, wherein said plurality of pivot restraints lock in an extended position thereby holding said first outrigger and said second outrigger in a deployed position.

8. The lift assist apparatus of claim 7, wherein said extendable support apparatus has an end configured to be placed an a floor, when said extendable support apparatus is substantially perpendicular to said floor said first outrigger and said second outrigger do not completely extend to said floor.

9. A lift assist apparatus for a wheeled stretcher having an end and a height adjustable undercarriage, the lift assist apparatus, comprising:

an extendable support apparatus detachably rotatably connectable to the end of the wheeled stretcher; and a stowage device connected to an end of said extendable support apparatus, said stowage device configured to hang on a portion of the wheeled stretcher.

10. A lift assist apparatus for a wheeled stretcher having an end and a height adjustable undercarriage, the lift assist apparatus, comprising:

an extendable support apparatus detachably rotatably connectable to the end of the wheeled stretcher; and a retention device connected to said extendable support apparatus, said retention device configured to releasably connect to a portion of the wheeled stretcher, said retention device having a contour that substantially matches a portion of a frame member of the wheeled stretcher.

11. A method of lifting a stretcher, comprising the steps of:

connecting a lift assist apparatus to a first end of the stretcher;

arranging said lift assist apparatus in a non-supporting position;

rotating said lift assist apparatus into a supporting position;

lifting a second end of the stretcher; and lowering a stretcher support mechanism, which is integral with the stretcher, to thereby engage a floor.

12. The method of claim 11, further comprising the steps of:

again arranging said lift assist apparatus in a non-supporting position;

extending said lift assist apparatus; and lifting said first end of the stretcher such that said lift assist apparatus again rotates into a supporting position.

13. The method of claim 12, further comprising the steps of:

again lifting said second end of the stretcher; and again lowering said stretcher support mechanism.

14. The method of claim 11, further comprising the step of detaching said lift assist apparatus from the stretcher.

15. The method of claim 14, further comprising the step of stowing said lift assist apparatus along a peripheral edge of the stretcher.

16. A wheeled stretcher assembly, comprising:

a stretcher having an end;

a height adjustable undercarriage connected to said stretcher; and a lift assist apparatus, including:

an extendable support apparatus detachably rotatably connected to said end of said stretcher.

17. The wheeled stretcher of claim 16, wherein said lift assist apparatus further comprises at least one outrigger connected to said extendable support apparatus.

18. The wheeled stretcher of claim 16, wherein said at least one outrigger includes a first outrigger and a second outrigger, said first outrigger pivotally connected to a side of said extendable support apparatus, said second outrigger pivotally connected to an other side of said extendable support apparatus.

* * * * *